US010864718B2

(12) United States Patent
Sandler et al.

(10) Patent No.: US 10,864,718 B2
(45) **Date of Patent: *Dec. 15, 2020**

(54) EMBOSSING WITH PRINTED RELIEF PATTERN

(71) Applicant: HP INDIGO B.V., Amstelveen (NL)

(72) Inventors: Mark Sandler, Rehovot (IL); Shai Lior, Rehovot (IL); Eyal Peleg, St Zoran (IL); Nati Sinuany, Nes Ziona (IL); Dror Kella, Nes-Ziona (IL); Shahar Stein, Zur Yizhak (IL); George Trendafilov, Nes Ziona (IL); Tsahi Rosenbaom, Rishon le zion (IL)

(73) Assignee: HP Indigo B.V., Amstelveen (NL)

( * ) Notice: Subject to any disclaimer, the term of this patent is extended or adjusted under 35 U.S.C. 154(b) by 635 days.

This patent is subject to a terminal disclaimer.

(21) Appl. No.: 15/076,600

(22) Filed: Mar. 21, 2016

(65) Prior Publication Data

US 2016/0200093 A1 Jul. 14, 2016

Related U.S. Application Data

(63) Continuation of application No. 14/116,321, filed as application No. PCT/EP2011/057632 on May 11, 2011, now Pat. No. 9,296,199.

(51) Int. Cl.
*B41F 19/02* (2006.01)
*B41F 19/06* (2006.01)
(Continued)

(52) U.S. Cl.
CPC ..... *B41F 19/02* (2013.01); *B41F 19/062* (2013.01); *B41J 3/38* (2013.01); *B44B 5/0047* (2013.01);
(Continued)

(58) Field of Classification Search
CPC ..... B41F 19/02; B41F 19/062; B44B 5/0047; B44B 5/026; B44B 5/02
See application file for complete search history.

(56) References Cited

U.S. PATENT DOCUMENTS 3,403,621 A * 10/1968 Hurwitz ..... B41F 19/02 101/142
4,671,538 A 6/1987 Calman
(Continued)

FOREIGN PATENT DOCUMENTS

EP 1428666 A1 6/2004
EP 1437882 A1 7/2004
(Continued)

OTHER PUBLICATIONS

EP 2 415 516 machine translation from espacenet.com; Author—The Internet; Jan. 14, 2015; Publisher—The Internet; Edition or Volume—First, limited edition.

*Primary Examiner* — Leslie J Evanisko
*Assistant Examiner* — Leo T Hinze
(74) *Attorney, Agent, or Firm* — Fabian VanCott

(57) ABSTRACT

An embossing apparatus includes an embossing die that includes a printed relief pattern made up of multiple layers of a deposited material. A resilient surface presses media against the embossing die such that embossed features corresponding to the embossing die are formed in the media. A method for embossing media includes forming an embossing die by depositing multiple layers of ink on a impression layer to form a relief pattern and pressing media against the embossing die to transfer the relief image to the media.

18 Claims, 6 Drawing Sheets

(51) Int. Cl.

| | |
|---|---|
| ***G03G 15/22*** | (2006.01) |
| ***G03B 15/00*** | (2006.01) |
| ***B41J 3/38*** | (2006.01) |
| ***B44B 5/00*** | (2006.01) |
| ***G03G 15/00*** | (2006.01) |

(52) U.S. Cl.
CPC ..... *G03G 15/221* (2013.01); *G03G 15/224* (2013.01); *G03G 15/6585* (2013.01)

(56) References Cited

U.S. PATENT DOCUMENTS

| | | | | |
|---|---|---|---|---|
| 4,766,811 | A | 8/1988 | Linska | |
| 5,407,771 | A | 4/1995 | Landa et al. | |
| 5,554,476 | A | 9/1996 | Landa et al. | |
| 6,170,393 | B1 * | 1/2001 | Hook | A61F 13/15707 101/5 |
| 6,248,211 | B1 * | 6/2001 | Jennings | D21F 11/14 162/111 |
| 7,078,141 | B2 | 7/2006 | Ben-Avraham et al. | |
| 7,977,023 | B2 | 7/2011 | Roditi et al. | |
| 9,056,520 | B2 * | 6/2015 | Cohen | B44B 5/02 |
| 2002/0048662 | A1 | 4/2002 | Bredahl | |
| 2004/0131778 | A1 * | 7/2004 | Verhoest | B41C 1/003 427/258 |
| 2005/0212184 | A1 * | 9/2005 | Filzmoser | B41C 1/003 264/509 |
| 2007/0234919 | A1 | 10/2007 | Lappe et al. | |
| 2008/0121123 | A1 | 5/2008 | Gebhardt | |
| 2009/0056864 | A1 | 3/2009 | Walther | |
| 2009/0091591 | A1 * | 4/2009 | Sivan | B41M 3/148 347/9 |
| 2009/0136679 | A1 * | 5/2009 | Boukaftane | B05D 1/002 427/510 |
| 2010/0007692 | A1 * | 1/2010 | Vanmaele | B41C 1/003 347/21 |
| 2010/0053289 | A1 | 3/2010 | Thompson | |
| 2011/0195266 | A1 | 8/2011 | Spoto | |
| 2011/0249048 | A1 * | 10/2011 | Gullentops | B29C 67/0059 347/5 |

FOREIGN PATENT DOCUMENTS

| | | | |
|---|---|---|---|
| EP | 2199065 | A1 | 6/2010 |
| EP | 2412516 | A2 | 2/2012 |
| JP | S53-134859 | | 11/1978 |
| JP | H06-135093 | | 5/1994 |
| JP | 2006-235264 | | 9/2006 |
| JP | 2007-054989 | | 3/2007 |
| JP | 2007090670 | A | 4/2007 |
| JP | 2008-528315 | | 7/2008 |
| JP | 2009-184254 | | 8/2009 |
| JP | 2010-191925 | | 9/2010 |
| KR | 20070095682 | A | 10/2007 |

* cited by examiner

EMBOSSING WITH PRINTED RELIEF PATTERN

BACKGROUND

Embossing is sometimes used to create raised images and designs in printed paper or other printed media. Embossing is normally performed as a post printing process on dedicated embossing machinery. Embossing machines typically involve the design and manufacture of a two piece die. The embossing machines place a portion of the media between the two pieces and then press the two pieces of the die together. This mechanically deforms the media to create the embossed image. These embossing techniques may have a number of disadvantages, including the delay in manufacturing the die, the cost of purchasing/maintaining separate embossing machines, and the significant amount of effort involved in the separate post-printing embossing run.

BRIEF DESCRIPTION OF THE DRAWINGS

The accompanying drawings illustrate various examples of the principles described herein and are a part of the specification. The illustrated examples are merely examples and do not limit the scope of the claims.

Throughout the drawings, identical reference numbers designate similar, but not necessarily identical, elements.

DETAILED DESCRIPTION

Figure 1:
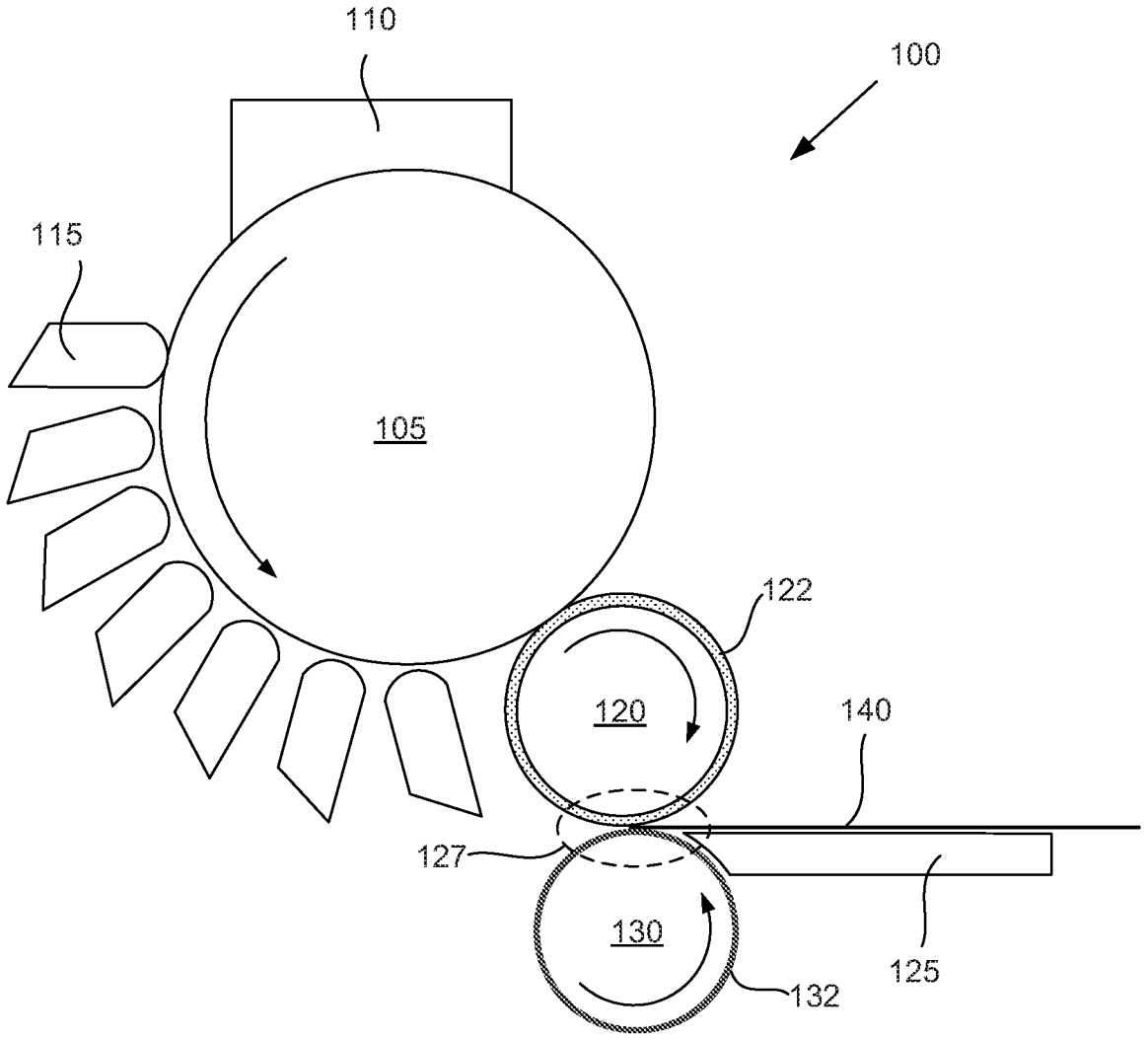
FIG. 1 is a diagram of an illustrative digital Liquid Electro Photographic (LEP) printing system, according to one example of principles described herein.

Embossing is sometimes used to create raised images and designs in printed paper or other printed media. These raised images provide texture, emphasis, and visual effects to the media. The embossed images can include a variety of additional characteristics, including printed images, gloss, lamination, or security features.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with the example is included in at least that one example, but not necessarily in other examples.

The examples and methods described below provide for embossing of a wide range printable media. In one illustrative example, printed relief patterns are used to form the embossing die. The printed relief pattern can be formed using a variety of printing processes and, in some examples, can be printed by the same printer that forms ink images on the media. The media is pressed against the printed relief patterns to form the embossed image in the media. This process is integrated into the normal printing flow within the printer. This eliminates delay, handling, and overhead of traditional embossing systems.

As used in the specification and appended claims, the term "printed relief pattern" refers to ink structures having a thickness or height sufficient to emboss a media pressed against the printed relief pattern. For example, a typical printed relief pattern may have a height of between approximately 0.1 millimeters and 2 millimeters or more. In some examples, the printed relief pattern may be formed from multiple layers of ink. Factors which may influence the height of printed relief pattern include: the desired height of the embossed image, the capacity of the printing technique in depositing ink layers, and the structural characteristics of the cured ink.

In some examples the printed relief patterns are created using digital printing processes. Digital printing processes transform digital data into a printed image in fractions of a second. Additionally, digital printing allows for successive images to change without slowing or reconfiguring the printer. Thus, the ink layers which make up the printed relief patterns can be rapidly formed in any pattern described by the digital data. The cost of printed relief patterns correlates to the cost of operating the printing press for tens of seconds and the amount of ink contained in the printed relief pattern. This can be a significant cost savings over designing a brass, bronze or copper embossing die, sending out the die for machining, waiting to receive the die from the machinist, installing the die in a dedicated embossing machine, and managing the post-printing embossing run. Consequently, the use of printed relief patterns as embossing die can enable low cost, rapid embossing runs which occur during the normal printing work flow. As used in the specification and appended claims, the term "ink" refers broadly to material deposited onto a surface by a printer or press. For example, the term "ink" includes liquid toners, dry toners, UV cured inks, thermally cured inks, inkjet inks, pigment inks, dye based inks, solutions without colorant, solvent based inks, water based inks, plastisols, or other appropriate solutions.

The digital embossing technique can be performed using a number of printing technologies, including Liquid Electro Photographic (LEP) printing, xerography and inkjet printers. The term "Liquid Electro Photographic" or "LEP" refers to a process of printing in which a liquid toner is applied through an electric field onto a surface to form an electrostatic pattern. In most LEP processes, this pattern is then transferred to at least one intermediate surface, and then to a print medium. During the operation of a digital LEP system, ink images are formed on the surface of a photo-imaging cylinder. These ink images are transferred to a heated blanket cylinder and then to a print medium. The photo-imaging cylinder continues to rotate, passing through various stations to form the next image.

The term "nip" refers to a region between two rollers where the rollers are in closest proximity. When a media sheet or other material passes through the nip, the distance between the two rollers can be adjusted to produce pressure on the media.

FIG. 1 is a diagram of an illustrative digital LEP system (100). The desired image is communicated to the printing system (100) in digital form. The desired image may include any combination of text, graphics and images. The desired image is initially formed on the photo-imaging cylinder (105), transferred to the blanket cylinder (120), and then transferred to the print medium (140).

According to one illustrative example, an image is formed on the photo-imaging cylinder (105) by rotating a clean, bare segment of the photo-imaging cylinder (105) under the photo charging unit (110). The photo charging unit (110) includes a charging device such as corona wire, charge roller, or other charging device and a laser imaging portion. A uniform static charge is deposited on the photo-imaging cylinder (105) by the photo charging unit (110). As the photo-imaging cylinder (105) continues to rotate, it passes the laser imaging portion of the photo charging unit (110) that dissipates the static charges in selected portions of the image area to leave an invisible electrostatic charge pattern that represents the image to be printed.

Ink is transferred onto the photo-imaging cylinder (105) by Binary Ink Developer (BID) units (115). There is one BID unit (115) for each ink color. During printing, the appropriate BID unit is engaged with the photo-imaging cylinder (105). The engaged BID unit presents a uniform film of ink to the photo-imaging cylinder (105). The ink contains electrically charged pigment particles which are attracted to the opposing electrical fields on the image areas of the photo-imaging cylinder (105). The ink is repelled from the uncharged, non-image areas. The photo-imaging cylinder (105) now has a single color ink image on its surface.

The photo-imaging cylinder (105) continues to rotate and transfers the ink image to a blanket cylinder (120). The blanket cylinder transfers the image to a sheet of media wrapped around the impression cylinder (130). As will be further described below, this process may be repeated for each of the colored ink layers to be included in the final image.

The print medium (140) enters the printing system (100) from the right, passes over a feed tray (125), and is wrapped onto the impression cylinder (130). As the print medium (140) contacts the blanket cylinder (120), the single color ink image is transferred to the print medium (140). The creation, transfer, and cleaning of the photo-imaging cylinder (105) is a continuous process, with hundreds of images being created and transferred per minute.

To form a single color image (such as a black and white image), one pass of the print medium (140) through the impression cylinder (130) and the blanket cylinder (120) completes the desired image. For a color image, the print medium (140) is retained on the impression cylinder (130) and makes multiple contacts with the blanket cylinder (120) as it passes through the nip (127). At each contact, an additional color plane may be placed on the print medium (140).

For example, to generate a four color image, the photo charging unit (110) forms a second pattern on the photo-imaging cylinder (105) which receives the second ink color from a second BID unit (115). As described above, this second ink pattern is transferred to the blanket cylinder (120) and impressed onto the print medium (140) as it continues to rotate with the impression cylinder (130). This continues until the desired image with all four color planes is formed on the print medium. Following the complete formation of the desired image on the print medium (140), the print medium (140) can exit the machine or be duplexed to create a second image on the opposite surface of the print medium (140). Because the printing system is digital, the operator can change the image being printed at any time and without manual reconfiguration.

According to one illustrative example, the digital offset LEP system (100) can be adapted to perform embossing in addition to printing. The impression cylinder (130) is covered by an impression layer (132). This impression layer (132) absorbs and captures excess ink to minimize maintenance and image quality issues. For example, when a paper jam occurs, ink intended for the absent paper may be instead deposited on the impression layer (132). As part of the jam clearing process, the operator may replace the impression layer (132) before restarting the printing operation. The printer design facilitates the rapid and convenient replacement of the impression layer (132).

To perform embossing with the digital offset LEP system, the media feeding through the press (100) is temporarily stopped. Ink images are repeatedly deposited on the impression layer (132) to accumulate and build up a two or three dimensional relief ink image which serves as the embossing die. The ink deposition process occurs as described above, with an electrostatic image being created on the photo-imaging cylinder (105) and the photo-imaging cylinder (105) receiving ink from a BID unit (115) to form an ink image on the photo-imaging cylinder (105). The image is transferred to the surface of the resilient layer (122) on the blanket cylinder (120) and then to the impression layer (132). The ink image is cured on the impression layer (132). This process is repeated to deposit multiple layers of cured ink and forms the printed relief pattern that serves as an embossing die. In some implementations, the process may pause after the deposition of one or more ink layers or may incorporate null printing cycles where no ink is deposited.

The description of embossing using printed relief patterns created on a LEP printer is only an illustrative example. A variety of other printing methods and systems could be used to create printed relief patterns and emboss media. Additional illustrative examples are described below.

Figure 2A:
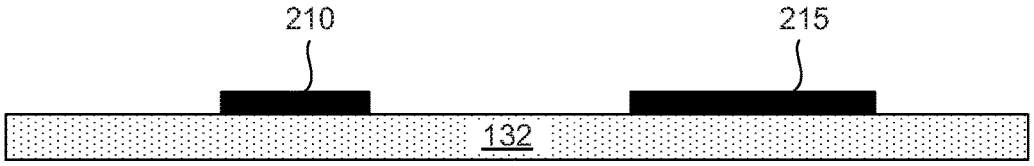
FIG. 2A-2D are cross sectional diagrams of an illustrative embossing process which uses a printed relief pattern as an embossing die, according to one example of principles described herein.
Figure 2B:
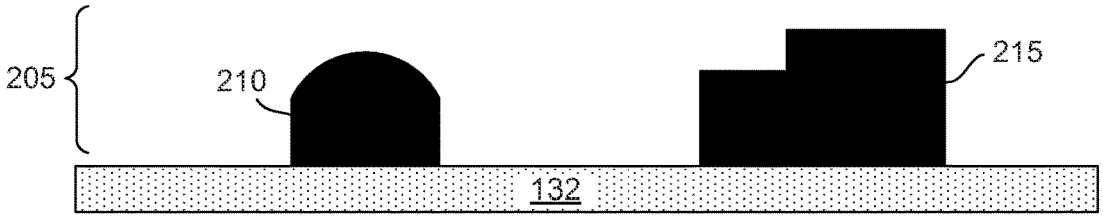

FIG. 2A is a cross sectional diagram of the impression layer (132) with several ink structures (210, 215) beginning to be formed. Additional ink layers are deposited to further build up the ink structures (210, 215). FIG. 2B is a cross sectional diagram of the impression layer (132) with the completed printed relief pattern (205). As discussed above, the printed relief pattern (205) may be formed from a plurality of ink layers. For example, each LEP ink layer may be approximately 0.5 to 1 micron in thickness. The structures may include hundreds of layers, each of which can be individually shaped to create the desired structure. In this example, a first structure (210) has a rectangular body with a rounded top. This rounded top may be created by depositing ink layers with progressively smaller areas of ink on top of the rectangular body. The taller structure (215) on the right has more layers than the first structure (210) and is consequently taller. The taller structure (215) has a terraced shape formed by depositing a series of two distinctly different shaped ink layers. The lower portion of the structure (215) is formed from ink layers with larger areas and the upper portion of the structure (215) is formed by depositing ink layers with smaller areas.

The ink used to form the structures (210, 215) may be any color or may have no color at all. The ink is selected so that its mechanical properties facilitate the formation of a printed relief pattern. For example, the ink may be selected for its adhesive or structural characteristics. In some implementations, different inks may be used in different layers of the structures. For example, an adhesive ink may be used as a first layer to securely bind the structures to the impression layer. The other layers may be built using inks which have more structural properties and are designed to withstand repeated compression during the embossing process. A top layer may be selected so that it does not stick to the media that is being embossed.

Figure 2C:
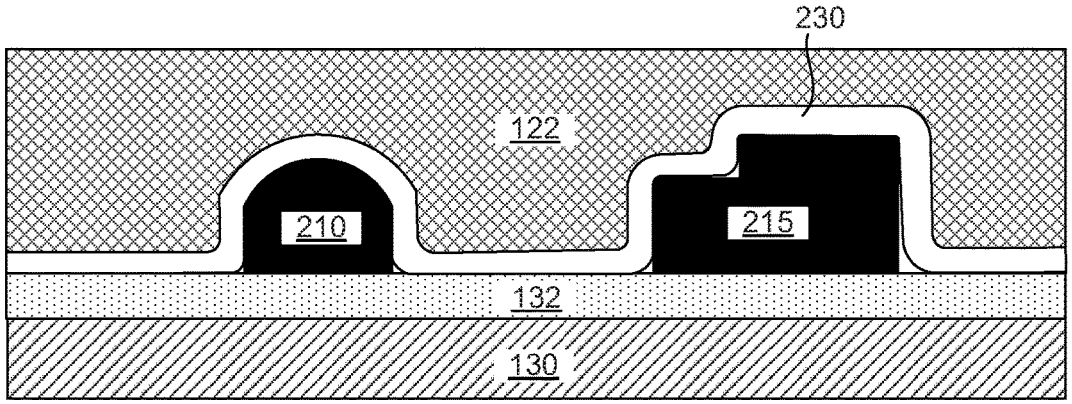
Figure 2D:
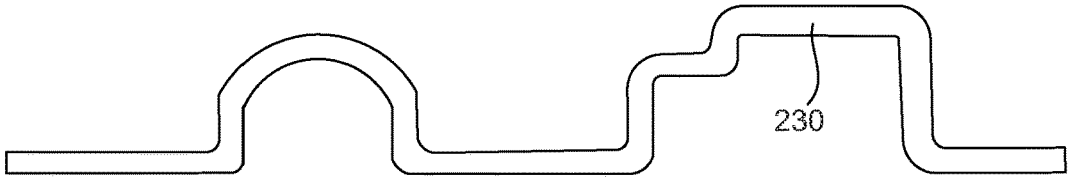

FIG. 2C shows a sheet of media (230) that has been placed over the ink structures (210, 215). The structures (210, 215) of the printed relief pattern are supported by the impression layer (132) and the impression cylinder (130). The sheet of media (230) is pressed against the printed relief pattern (205) by a resilient body. The resilient body could be any of a number of devices, including a compliant plate, a roller, or other suitable device. In this example, the resilient body is the layer (122) of the blanket cylinder (120 FIG. 1). In the nip where the surfaces of the blanket cylinder (120 FIG. 1) and impression cylinder (130) are in closest proximity, the resilient layer (122) can exert a predetermined amount of pressure on the media (230) and force the media (230) over and into the ink structures (210, 215) which make up the printed relief pattern (205, FIG. 2B). This creates an embossed image on the media (230) that corresponds to the underlying printed relief pattern (205, FIG. 2B). FIG. 2D shows a portion of the media (230) with an embossed shape/image that corresponds to the printed relief pattern (205, FIG. 2B).

The diagram shown in FIG. 2C is only an illustrative example. A number of modifications could be made according to the design parameters for a particular task. For example, an adhesive layer or material could be added to increase adhesion of the ink relief pattern to the impression layer. This adhesive material may be deposited in a number of ways. For example, the printer may deposit the adhesive material on the impression layer prior to depositing the ink layers, the adhesive material may be coated onto the impression layer during manufacturing, or the adhesive material may be manually deposited on the impression layer.

Figure 3:
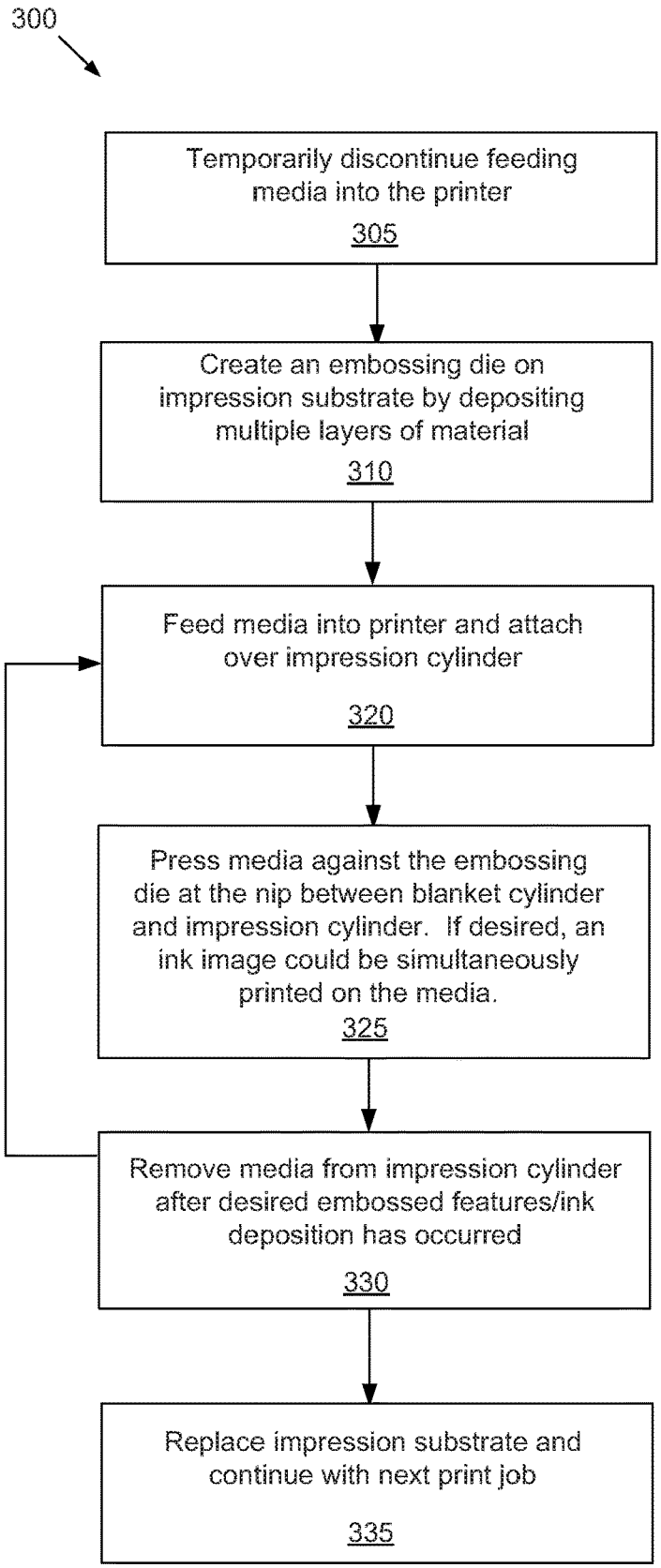
FIG. 3 is a flowchart of an illustrative method for embossing using printed relief patterns, according to one example of principles described herein.

FIG. 3 describes an illustrative method (300) for implementing digital embossing as described above in FIGS. 2A-2D on the LEP printing system described in FIG. 1. The method (300) includes temporarily discontinuing the feeding of media into the printer (block 305). Digital data which describes the desired printed relief pattern is input into the printer. The photo imaging cylinder continues to rotate and generates a first ink layer which will form the first layer of the embossing die. This image is transferred to the blanket cylinder and then onto the impression layer. As discussed above, the impression layer is wrapped around and rotates with the impression cylinder. This process continues and the embossing die is created on the impression layer (block 310). For example, the printer may transfer ten or more ink layers to the impression layer per second. Consequently, creating an embossing die containing hundreds of layers can be accomplished in tens of seconds. The properties of LEP inks allow deposition of printing ink layers on top of previous layers with virtually no limitation.

After the embossing die is formed, the media is again fed into the printer and attached over the embossing die on the impression cylinder (block 320). A wide variety of media can be used. For example, cellulose based media ranging from 60 grams per meter square to 350 grams per meter square have been used. Other types and weights of media can also be used. As each sheet of media passes though the nip, it is pressed against the embossing die at the nip between the blanket cylinder and the impression cylinder (block 325). As discussed above, this embosses the media by pressing it over and into the ink structures which make up the embossing die. If desired, an ink image could be simultaneously printed on the media.

The media may be retained on the impression cylinder for a number of revolutions. Each time the media passes through the nip, it is again pressed over the printed relief pattern. For example, the impression cylinder may rotate the media through the nip four times before releasing the media. This may have a number of advantages, including sharper embossed images and an opportunity to print an image on the media with four color layers. The number of passes through the nip can be adjusted according to the characteristics of a given print run.

The pressure and temperature of the blanket cylinder and the impression cylinder can be controlled to produce the desired embossed image. The pressure can be controlled by adjusting the distance between the two cylinders and/or adjusting the resiliency/thickness of the resilient layer. The temperature of the cylinders and resilient layer can be adjusted by controlling heat flux into and out of the cylinders. For example, the temperature may be increased using radiative, convective or conducted heat. The temperature may be lowered by reducing the input heat flux or increasing a cooling convective flow.

In some examples, the printer may also deposit ink on the media as it is performing the embossing. The deposition of ink on the media is performed as described above with respect to FIG. 1. The ink may be deposited over any region of the media, including areas with embossing and areas with no embossing. The embossed media is removed from the impression cylinder after the desired embossed features and ink deposition has occurred (block 330).

This process is repeated by feeding the next sheet of media into the printer (block 320), pressing the media into the relief image (block 325) and removing the media (block 330). The process continues until the embossing run is complete. For example, the embossing die may be used to emboss runs that range from a single sheet of media to hundreds or thousands of sheets. Tests have shown that a single embossing die is sufficient to print at least 600 sheets of media. If the embossing die becomes damaged or worn, the media printing/embossing process can be momentarily stopped while the printer deposits additional layers on the embossing die to correct the embossing die. Alternatively, the impression layer can be replaced and the embossing die can be built over again. After the printing is complete, the impression layer is replaced and printing continues as usual with the next print job (block 335).

The illustrative systems and methods described above are only one example of embossing using a printed relief pattern as the embossing die. As used in the specification and appended claims, the term "embossing" is used broadly to include both raised areas and depressed areas formed in a media surface.

Figure 4A:
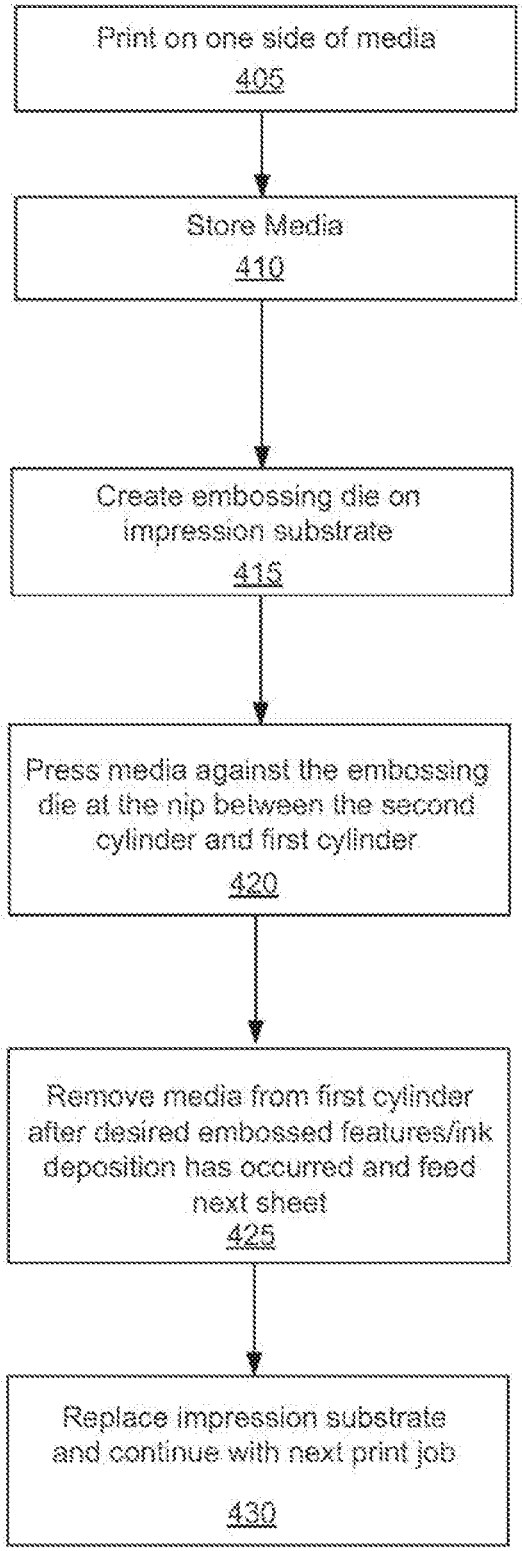
FIGS. 4A and 4B are a flowchart and diagrams, respectively, of an illustrative digital embossing process, according to one example of principles described herein.
Figure 4B:
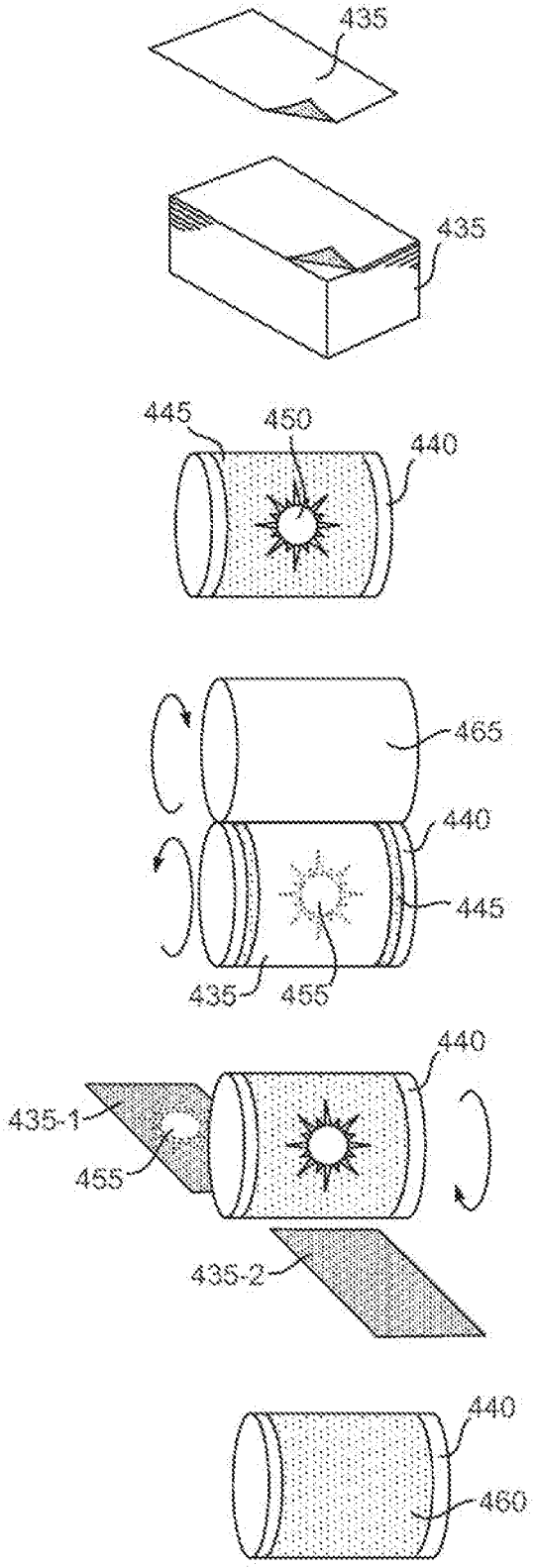

FIGS. 4A and 4B show an illustrative method for digital embossing of media sheets (435) that have been printed on one side (block 405). These printed sheets are stored (block 410) either in the printer itself or at a separate location. The embossing die (450) is created on an impression layer (445) wrapped around a first cylinder (440) (block 415). In this example, the embossing die (450) is illustrated as a rayed sun. As discussed above, the embossing die (450) could have a wide variety of shapes and cover any portion of the impression layer (445). The embossing die (450) is made up of a printed relief pattern of multiple layers of deposited material.

The printed media are then fed into the printer and pressed into the embossing die (450) at the nip between a second cylinder (465) and the first cylinder (440) (block 420). The second cylinder (465) is covered with a resilient surface which presses the media against the embossing die (450) such that embossed features corresponding to the embossing die (450) are formed in the media (435). As discussed above, the media (435) may make multiple passes through the nip. For example, the first cylinder (440) may rotate the media (435) through the nip four times before releasing the media (435). This creates an embossed image (455) in the printed media (435). As discussed above, in addition to embossing the image, the printer may simultaneously print images on exposed surfaces of the media.

In one example, the registration of the printed media with the printed relief pattern can be performed using systems which are already in place within the printer. The registration between the printed media and the relief image insures proper alignment between the printed image and the embossing produced by the printed relief pattern. For example, the printed relief pattern and the printed media can be aligned using systems which register different colors of ink images on a sheet or using systems which align duplex printed sheets to insure that images placed on a second side of a sheet are aligned with images already printed on the first side of the sheet.

After the desired embossed features/ink deposition has occurred, the media (435-1) is removed and the next sheet of media (435-2) is fed onto the impression layer (block 425). When all the media has been embossed, the impression layer (445) can be replaced with a new sheet (460) and printing can continue with the next print job (block 430).

Figure 5A:
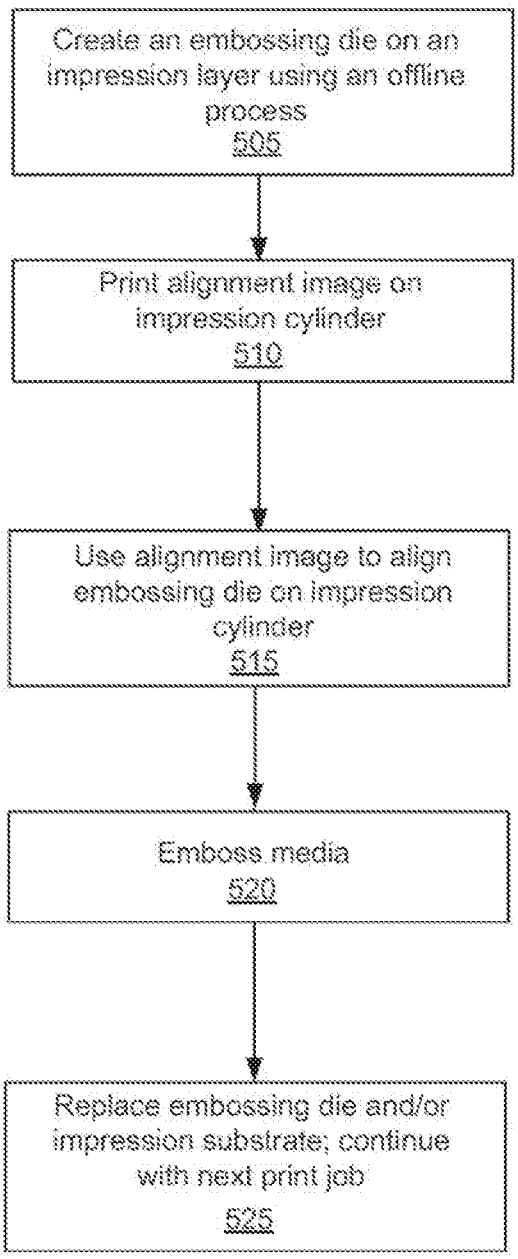
FIGS. 5A and 5B are a flowchart and diagrams, respectively, of an illustrative embossing process, according to one example of principles described herein.
Figure 5B:
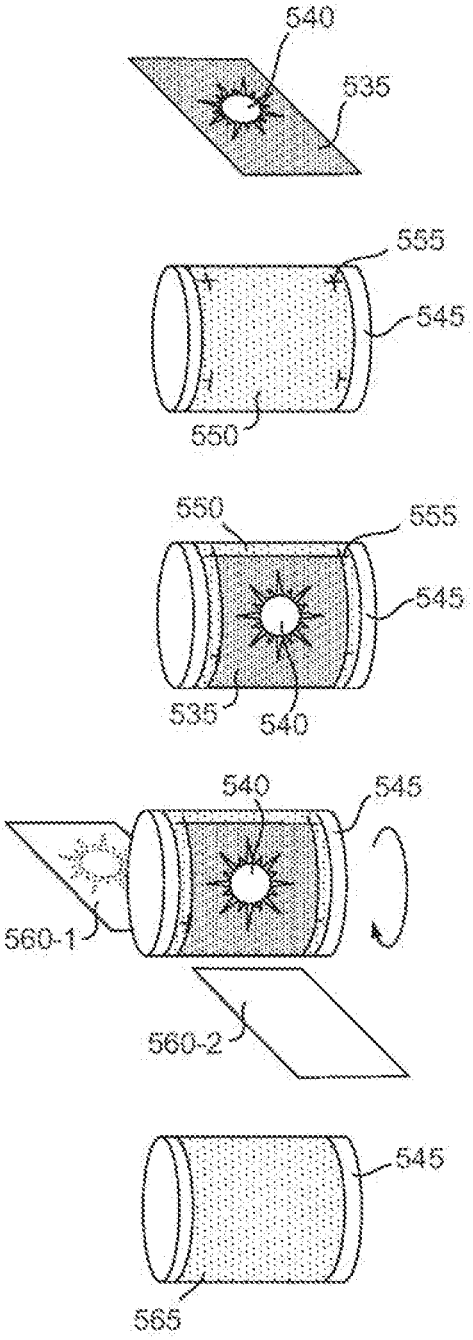

FIGS. 5A and 5B are illustrative examples of an alternative system and method for performing embossing using a relief image which is created offline. As used in the specification and appended claims the term "offline" refers to a system, printer or process which operates independently from the embossing system. For example, the relief images may be created by applying a patterned adhesive film onto an impression layer, using offline embossing machinery to create a relief image or creating a printed relief pattern on an impression layer using an offline printer. The impression layer may be specifically designed for this purpose.

In this illustrative method, an embossing die (540) is formed on an impression layer (535) using an offline process (block 505). For example, an inkjet printer that deposits UV cured polymer inks or thermally curable inks could be used. The ink layers created by UV cured polymer inks can be significantly thicker than ink layers deposited by the LEP printing process. Consequently, fewer ink layers may form the desired embossing die (540). The impression layer (535) may be formed from any of a number of materials, including film, plastic, KAPTON, or other material. In some instances, the embossing die (540) may be formed using techniques other than ink deposition. For example, the embossing die (540) may be created using a letter press.

To properly align the separately formed embossing die (540), an alignment image or images (555) can be printed on the impression layer (550) (block 510). The alignment image(s) can be used to align the embossing die (540) on the impression cylinder (545) (block 515). The embossing die (540) can be adhered to the impression cylinder (545) in a number of ways, including adhesive, vacuum suction, electrostatic forces, clamping or other techniques.

The media (560) is then fed into the printer and embossed (block 520). After the desired media is embossed, the impression layer (535) containing the embossing die (540) can be replaced and printing can continue with the next job (block 525).

Figure 6A:
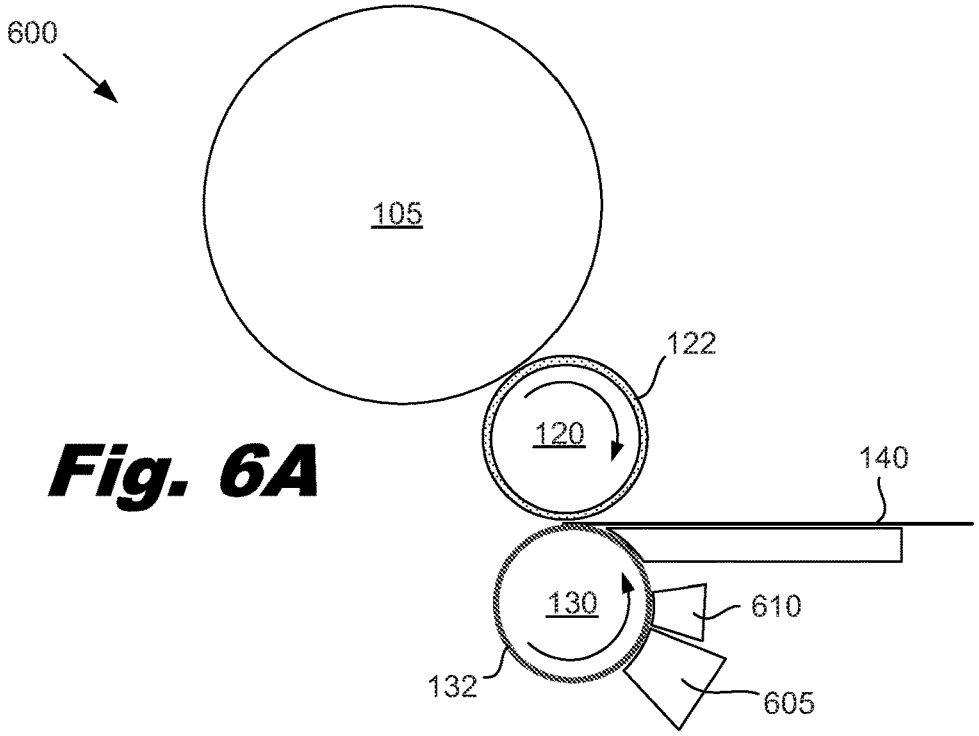
FIG. 6A is a diagram of a LEP printing system which uses an illustrative inline inkjet printer to create printed relief patterns for embossing, according to one example principles described herein.

FIG. 6A is a diagram of a LEP printing system (600) which uses an inline inkjet printer (605, 610) to create printed relief patterns directly on the impression layer (132). The inline printer (605, 610) may use a variety of technologies to deposit the printed relief pattern on the impression layer (132). For example, the inline printer may be an inkjet which deposits UV curable inks onto the impression layer (132). The inline printer may include an inkjet printhead (605) and a UV curing station (610). The printhead (605) may be configured to deposit only one color of UV ink or it may be configured to print a full pallet of UV inks. In one example, the inline printer (605, 610) may print a colorless ink onto the impression layer (132). Additionally or alternatively, the inline inkjet printer (605, 610) may also be configured to deposit UV curable inks directly onto the media as it passes beneath the inline inkjet printer (605, 610). This can create raised or textured surfaces over or under the LEP deposited images on the media (140).

Figure 6B:
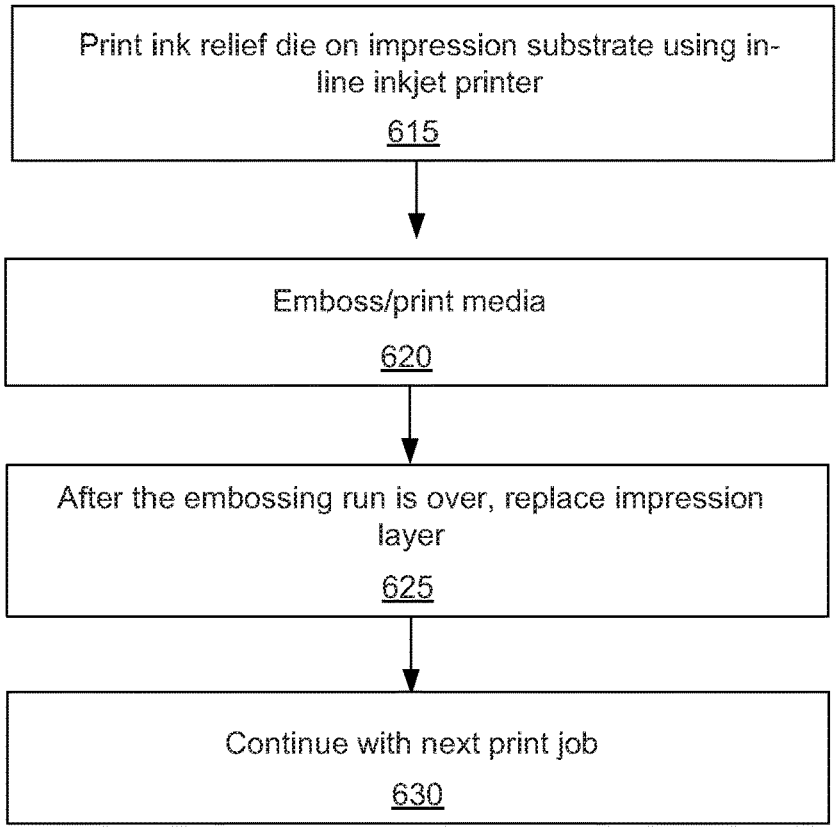
FIG. 6B is a flowchart of an illustrative method for using the LEP printing system of FIG. 6A for media embossing, according to one example of principles described herein.

FIG. 6B is a flowchart of an illustrative method for using the LEP printing system of FIG. 6A for media embossing. The inline inkjet printer (605, 610) forms the printed relief pattern on the impression layer (132) (block 615). The LEP printing system (600) then embosses/prints the media (140) (block 620). After the embossing run is over, the impression layer (132) is replaced (block 625) and printing continues with the next print job (block 630).

In conclusion, the digital creation of a printed relief pattern for embossing is a very flexible technique for creating embossed images on media. A wide variety of printing technologies can be used to deposit layers of ink to create the printed relief pattern. The printed relief pattern is used inside a printer to perform embossing of the media. This eliminates the cost, time and space consumed by external embossing machines. In other examples, the relief image is formed by an offline process and used in a printer for inline embossing.

The preceding description has been presented only to illustrate and describe examples of the principles described. This description is not intended to be exhaustive or to limit these principles to any precise form disclosed. Many modifications and variations are possible in light of the above teaching.

What is claimed is:

1. An embossing apparatus comprising:

an embossing die made up of a printed relief pattern made up of multiple layers of a deposited material;

a first cylinder having a resilient surface to deposit an ink image onto a media, the resilient surface for pressing the media against the embossing die such that embossed features corresponding to the printed relief pattern on the embossing die are formed in the media; and an impression layer in a printer comprising a printed alignment image, the embossing die to be aligned with the alignment image on the impression layer of the printer.

2. The apparatus of claim 1, in which the printer comprises one of: an LEP printer and a xerographic printer.

3. The apparatus of claim 1, further comprising the printed relief pattern of multiple layers of deposited material.

4. The apparatus of claim 1, wherein the deposited material comprises multiple layers of ink.

5. The apparatus of claim 4, in which the multiple layers of ink comprise different inks.

6. The apparatus of claim 1, wherein a first layer of deposited material is an adhesive material.

7. The apparatus of claim 1, further comprising an offline printer to generate the embossing die.

8. A printing system for simultaneous printing and embossing media comprising:

a first cylinder;

an embossing die on the first cylinder, the embossing die made up of a printed relief pattern;

an impression layer in a printer comprising a printed alignment image;

a second cylinder forming a nip with the first cylinder such that media passing through the nip is pressed against the embossing die; and a photo-imaging cylinder to deposit an ink image on the second cylinder, the second cylinder being configured to transfer the ink image to the media as the media passes through the nip.

9. The system of claim 8, further comprising a printhead to deposit multiple layers of material to form the printed relief pattern on the embossing die.

10. The system of claim 8, further comprising the printed relief pattern, the printed relief pattern comprising multiple layers of ink.

11. The system of claim 10, in which the multiple layers of ink comprise different types of ink.

12. The system of claim 8, wherein the photo-imaging cylinder is part of a printing device that comprises one of: a Liquid Electro Photographic (LEP) printer and a xerographic printer.

13. The system of claim 8, wherein the impression layer is wrapped around the first cylinder.

14. The system of claim 8, further comprising a resilient surface on the second cylinder for pressing media against the embossing die.

15. The printing system of claim 8, further comprising an offline printer to generate the embossing die.

16. An embossing apparatus comprising:

an embossing die made up of a printed relief pattern made up of multiple stacked layers of a deposited material;

a first cylinder having a resilient surface to press a print medium against the embossing die such that embossed features corresponding to the printed relief pattern on the embossing die are formed in the print medium; and an impression layer in a printer comprising a printed alignment image with the embossing die.

17. The apparatus of claim 16, further comprising a printer to deposit the multiple layers of deposited material of the printed relief pattern.

18. The apparatus of claim 16, wherein the impression layer is wrapped around the first cylinder.

* * * * *